US006425683B1

(12) United States Patent
Kusagaya et al.

(10) Patent No.: US 6,425,683 B1
(45) Date of Patent: Jul. 30, 2002

(54) VEHICLE HEADLAMP

(75) Inventors: Masahiro Kusagaya; Kaoru Yamamoto, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/679,860

(22) Filed: Oct. 5, 2000

(30) Foreign Application Priority Data

Oct. 5, 1999 (JP) ..... 11-284951

(51) Int. Cl.[7] ..... F21V 17/02
(52) U.S. Cl. ..... 362/512; 362/324; 362/513
(58) Field of Search ..... 362/512, 509, 362/277, 465, 351, 538, 539, 303, 305, 513, 319, 320, 322, 324

(56) References Cited

U.S. PATENT DOCUMENTS

| | | | | |
|---|---|---|---|---|
| 4,857,794 A | | 8/1989 | Watanabe | 313/113 |
| 5,213,406 A | | 5/1993 | Neumann et al. | 362/61 |
| 5,373,424 A | | 12/1994 | Ishikawa | 362/61 |
| 5,707,129 A | | 1/1998 | Kobayashi | 326/66 |
| 5,899,559 A | * | 5/1999 | Lachmayer et al. | 362/513 |
| 6,036,342 A | * | 3/2000 | Aoki | 362/539 |
| 6,286,985 B1 | * | 9/2001 | Ohshio et al. | 362/512 |

FOREIGN PATENT DOCUMENTS

| | | | | |
|---|---|---|---|---|
| GB | 2332742 A | | 6/1999 | B60Q/1/076 |
| GB | 2341672 A | | 3/2000 | B60Q/1/14 |
| GB | 2341673 A | | 3/2000 | B60Q/1/14 |
| JP | 10-241409 | * | 9/1998 | |

* cited by examiner

*Primary Examiner*—Sandra O'Shea
*Assistant Examiner*—Bao Truong
(74) *Attorney, Agent, or Firm*—Fish & Richardson P.C.

(57) ABSTRACT

A shade for screening part of reflected light from a light source is rotated between a low beam and a high beam positions providing a different amount of screened light. The beam switching device comprises a tension coil spring for elastically biasing the shade toward the low beam position and a solenoid constructed to press against the shade against the elastic biasing force of the tension coil spring so that the shade rotates to reach the high beam position. The solenoid is constructed to simply press against the shade. The beam switching device can be assembled to a reflector unit only by disposing the solenoid and the tension coil spring at predetermined positions, respectively.

14 Claims, 7 Drawing Sheets

VEHICLE HEADLAMP

FIELD OF THE INVENTION

The present invention relates to a vehicle headlamp designed to switch beams by moving a shade.

BACKGROUND OF THE INVENTION

A vehicle headlamp is constructed such that a beam for high beam or low beam is emitted by reflecting forward light from light source with a reflector. Since light distribution patterns for the low beam and the high beam are different, a general practice is to use two light sources and switch them on and off selectively such that the headlamp switches between the low beam and the high beam.

However, a vehicle headlamp is also constructed to switch beams using a single light source. In particular, such construction is found with many two-unit type headlamps, which has a discharge bulb as a light source bulb.

One conventional switching method using a single light source switches beams with a moving shade. In this method, the shade is designed to move between two positions providing different screening of incident light given off from a light source to a reflector or reflected light from the reflector, with a beam switching device containing an actuator such as a solenoid.

However, in a vehicle headlamp of the foregoing prior art beam switching device, since the shade and the actuator for driving the shade are coupled to each other with a pin or the like, the assembling of the beam switching device to a lamp is difficult and results in a low production performance.

Particularly, with the foregoing prior art beam switching device, the actuator needs to be unitized in advance by being coupled to the shade, and a resultant complicated massive unit has to be assembled to a lamp, making the assembling operation very cumbersome.

In addition to the drawback indicated for the foregoing device with beam switching between the low beam and the high beam by the moving shade, a similar drawback may occur if a beam switching is designed to take place between other beams, for example, between the low beam and a fog beam.

The present invention is provided in view of those situations. An object of the present invention is to provide a vehicle headlamp having a beam switching function performed by moving a shade, configured to facilitate assemblage of a beam switching device to the headlamp.

SUMMARY OF THE INVENTION

The present invention attains the above object by devising the construction of a beam switching device.

According to an embodiment of the invention, there is provided a vehicle headlamp comprising a light source, a reflector for reflecting forward light from the light source, a shade for screening part of incident light given off from the light source to the reflector or light reflected from the reflector and a beam switching device for switching beams by moving the shade between two positions providing a different amount of screening of the incident light or the reflected light. The beam switching device comprises an elastic member for elastically biasing the shade to either of the two positions and an actuator for pressing the shade against the elastic biasing force of the elastic member to move the shade to either of the two positions.

The "vehicle headlamp" may be a general headlamp having a reflector formed based on a paraboloid or a so-called projector-type headlamp.

The "light source" above is not limited to any specific one, but may be a discharge illuminant portion or a filament of an incandescent bulb such as a halogen bulb.

The "shade" maybe a shade for screening part of incident light given off from the light source to the reflector or part of reflected light reflected from the reflector.

The method for moving the shade "between two positions" is not limited to a specific method, but the movement of the shade may be effected through any rotary motion or linear reciprocating motion.

The "elastic member" is not limited to a specific kind of elastic member, but any kind of elastic member may be used, provided that it can elastically bias the shade to one or the other of the two positions. For example, a tension coil spring, a compression coil spring, a torsion coil spring, a plate spring, a rubber or the like may be used.

The "actuator" is not limited to a specific kind of actuator, but any kind of actuator may be used, provided that it can move the shade to either of the two positions against the elastic biasing force of the elastic member. For example, a solenoid, a motor cam mechanism or the like may be adopted.

As shown in the foregoing construction, the vehicle headlamp according to the invention comprises the beam switching device for switching beams by moving the shade for screening part of incident light given off from the light source to the reflector or light reflected from the reflector between two positions each providing a different amount of screening comprising a light source. The beam switching device comprises the elastic member for elastically biasing the shade to either of the two positions and the actuator for pressing the shade against the elastic biasing force of the elastic member to move the shade to either of the two positions. Thus, the vehicle headlamp of the invention obtain the following function and advantage.

Unlike the actuator of the conventional construction, which is coupled to the shade with a pin or the like, the actuator of the present invention is constructed to contact the shade detachably to press the shade against an elastic biasing force. Thus, the beam switching device can be assembled to the headlamp only by disposing the actuator and the elastic member at predetermined positions, respectively.

Thus, according to the present invention, the beam switching device can easily be assembled to the vehicle headlamp constructed such that the beam switching is carried out by the moving shade.

The mode of beam switching by the beam switching device is not limited to a specific mode. However, if the beam switching device is constructed to switch between the low beam and the high beam with one of the two positions set for the low beam and the other set for the high beam, and if the positioning member is constructed to be brought into abutment with the shade when the shade has moved to the low beam position, the shade can be located accurately at the low beam position when the high beam is switched to the low beam. The above configuration functions to obviate the necessity of alignment of the actuator such as required when the shade is located and retained at the low beam position, thereby making it possible to simplify the construction of the beam switching device.

The position where the beam switching device is disposed is not limited to a specific position, but if the position is located at the lower area of the reflector, the following function and advantage can be obtained. The lower area of the reflector is not as important as the other areas thereof with respect to the light distribution of the headlamp. In the event that the beam switching device is designed to be disposed in this lower area, the beam switching device can be disposed with a space saving construction needing no wide space, without adversely affecting the light distribution performance of the headlamp.

DETAILED DESCRIPTION OF THE INVENTION

Referring to the accompanying drawings, embodiments of the invention will be described below.

A first embodiment of the invention will be described.

Figure 1:
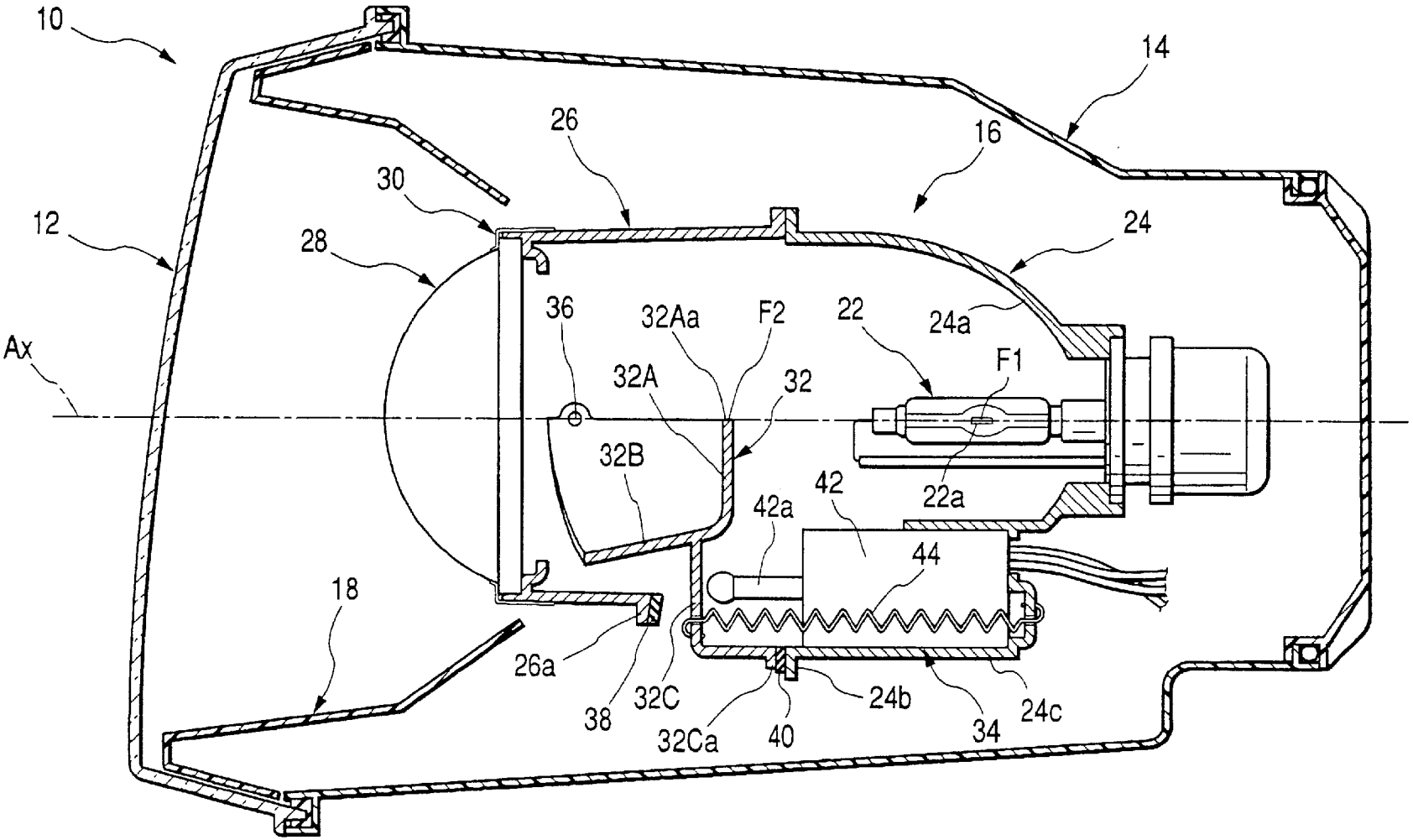
FIG. 1 is a side sectional view of a vehicle headlamp according to a first embodiment of the invention.

FIG. 1 is a side sectional view of a vehicle headlamp according to an embodiment of the invention.

As shown, a vehicle headlamp (a lamp) 10 according to an embodiment of the invention is a projector-type headlamp, in which a projector unit 16 is provided so as to tilt in vertical and lateral directions in a lamp chamber formed by a transparent front lens 12 and a lamp body 14. An extension panel 18 is provided in front of the projector unit 16.

Figure 2:
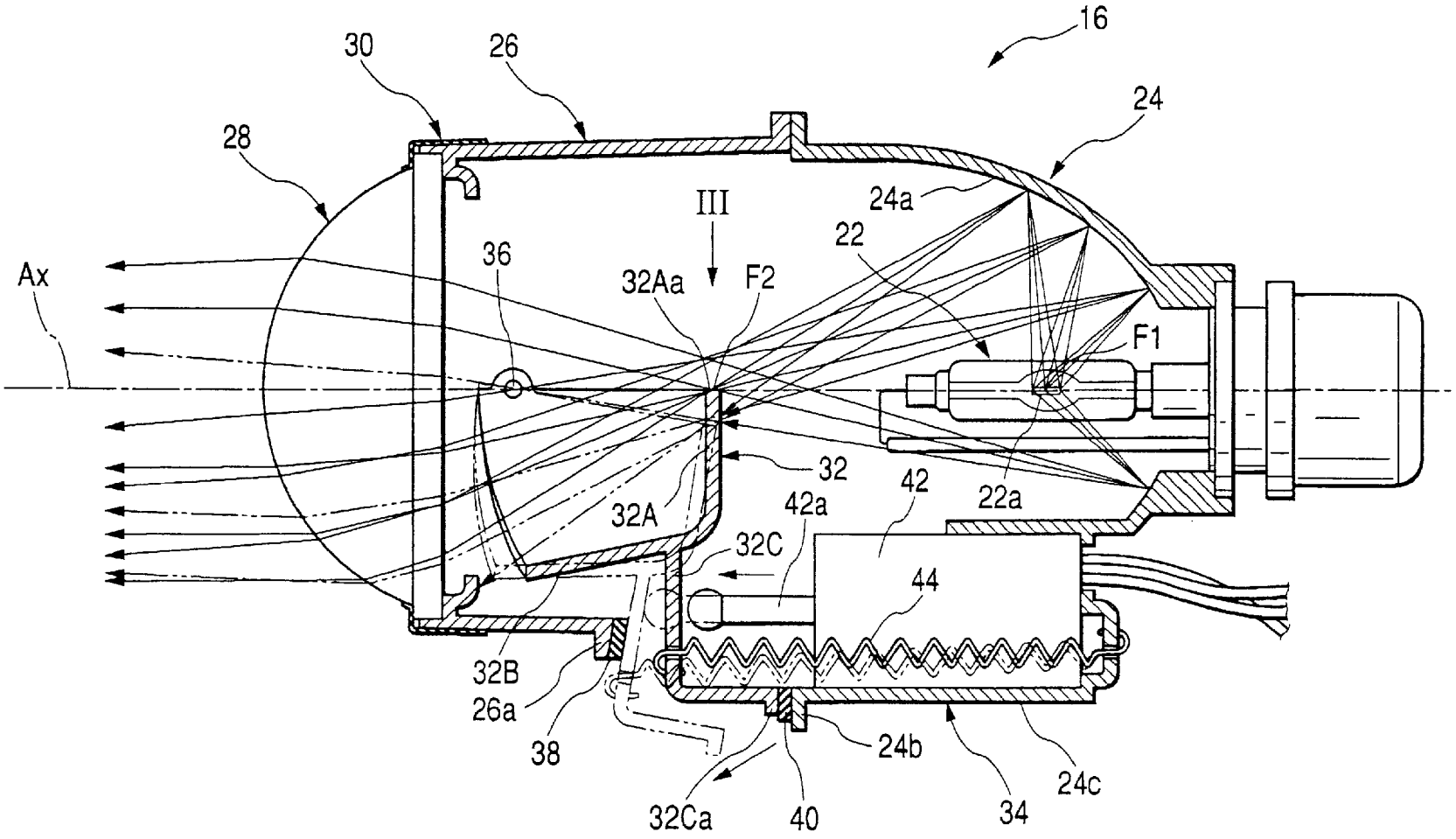
FIG. 2 is a side sectional view showing singly a projector unit for the vehicle headlamp according to an embodiment of the invention.
Figure 3:
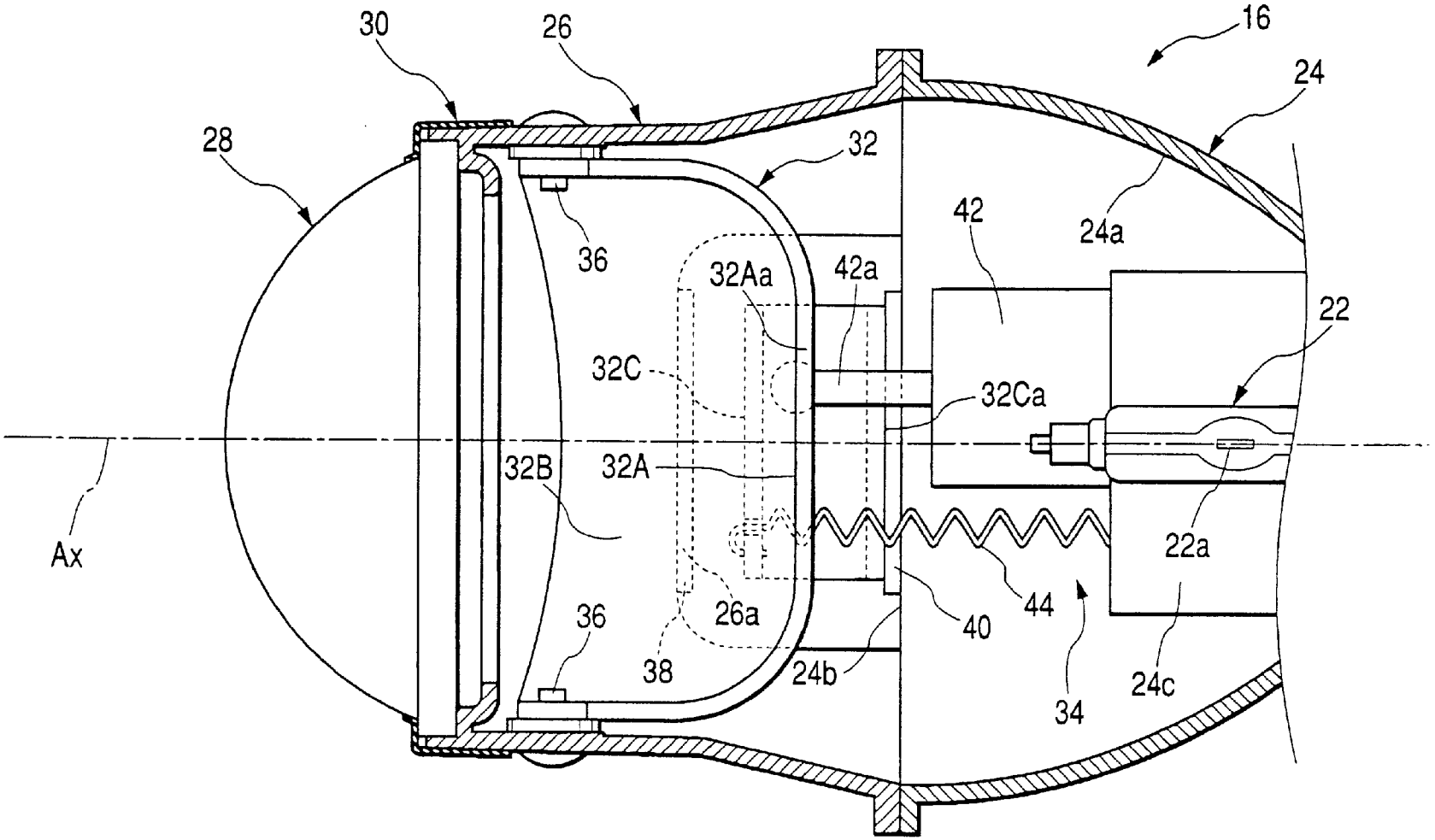
FIG. 3 is a view in the direction indicated by an arrow III of FIG. 2.

FIG. 2 is a side sectional view showing the projector unit 16 singly, and FIG. 3 is a view in the direction indicated by an arrow III in FIG. 2.

As shown in these figures, the projector unit 16 comprises a discharge bulb 22, a reflector 24, a holder 26, a retaining ring 30, a shade 32 and a beam switching device 34.

The discharge bulb 22 is a metal halide bulb and is attached to the reflector 24 in such a manner that a discharge illuminant body 22*a* (a light source) is located on a lamp optical axis Ax which extends in a longitudinal direction of a vehicle.

The reflector 24 has a substantially elliptically spherical (ellipsoidal) reflecting surface 24*a*. The sectional configuration of this reflecting surface 24*a* including the lamp optical axis Ax is constituted by an ellipse and is set such that the eccentricity gradually increases from a vertical section to a horizontal section. However, a rear apex of the ellipse constituting these respective sections is set at an identical position. The discharge illuminant portion 22*a* is disposed at a first focal point F1 of the ellipse constituting the vertical section. Because of this construction, the reflecting surface 24*a* is constructed so as to reflect forward light from the discharge illuminant portion 22*a* toward closer to the lamp optical axis Ax, and when this takes place, in the vertical section including the lamp optical axis Ax, the reflected light is designed to be substantially focused to a second focal point F2 of the ellipse.

The holder 26 is formed into a cylindrical shape which extends forward from a front end opening of the reflector 24 and is constructed so as to fixedly support the reflector 24 at a rear end thereof and a focusing lens at a front end thereof via a retaining ring 30.

The focusing lens 28 is constituted by a plano-convex lens having a convex surface at the front and a flat surface at the rear thereof and is disposed such that a rear focal point position thereof coincides with the second focal point F2 of the reflecting surface 24*a* of the reflector 24. Thus, the focusing lens 28 is constructed so as to transmit reflected light from the reflecting surface 24*a* of the reflector 24 therethrough to focus the light toward closer to the lamp optical axis Ax.

The shade 32 comprises a shade main body 32A extending substantially along a vertical plane intersecting at right angles with the lamp optical axis Ax, a substantially semi-cylindrical portion 32B extending forward from a peripheral edge portion of the shade main body 32A and a bracket portion 32C extending downwardly from a lower end of the substantially semi-cylindrical portion 32B and is provided rotatably at a lower portion in an internal space of the holder 26. In other words, the shade 32 is supported on the holder 26 via rotating pins 36 at front upper portions on left-hand and right-hand sides of the substantially semi-cylindrical portion 32B. The shade 32 can rotate about a horizontal axis connecting the two rotating pins between two positions; a low beam position (a position shown by solid lines) and a high beam position (a position shown by chain double-dashed lines in the figure).

When located at the low beam position, the shade 32 is disposed such that the upper end edge 32A*a* of the shade main body 32A passes through the second focal point F2. Part of reflected light from the reflecting surface 24*a* is screened so as to eliminate illuminating light oriented upward which is emitted from the lamp 10. Thus, an illuminating light for a low beam (a beam shown by solid lines) is obtained which is oriented downward relative to the lamp optical axis Ax. On the other hand, when located at the high beam position, the shade 32 releases the screening of the reflected light from the reflecting surface 24*a* and permits the illuminating light which is oriented upward to be emitted from the lamp 10. Thus,an illuminating light for a high beam (a beam indicated by chain double-dashed lines) can be obtained.

A lower end of the holder 26 is notched so as to allow the bracket portion 32C of the shade 32 to pass therethrough, and a positioning member 38 made of rubber is fixedly secured to a flange portion 26*a* at a rear end thereof. Thus, when the shade 32 rotates to reach the high beam position, the positioning member 38 is constructed so as to come into abutment with the bracket portion 32C of the shade 32.

A lower end of the bracket portion 32 of this shade 32 is formed so as to be bent into an L-shape oriented rearward. On the other hand, a positioning member 40 made of rubber is fixedly secured to a lower end flange portion 24*b* at the front end opening of the reflector 24. Thus, when the shade rotates to reach the low beam position, the positioning member 40 is constructed so as to come into abutment with a rear end flange portion 32C*a* of the bracket portion 32C.

The beam switching device 34 comprises a solenoid 42 (an actuator) and a tension coil spring 44 (an elastic member) Switching between the low beam and the high beam can be effected by rotating the shade 32 between the low beam position and the high beam position.

The solenoid 42 is inserted for attachment and fixed in place in a solenoid accommodating portion 24*c* formed in a lower area of the reflector 24, and an output rod 42*a* extends forward. Then, this solenoid 42 is constructed so as to selectively move the output rod 42*a* to either of a non-excited position (a position indicated by solid lines) and an excited position (a position indicated by chain lines), which is positioned forwardly to the non-excited position, when a signal is sent to the solenoid 42 from a beam selector switch, which is not shown. When located at the non-excited position, a distal end of the output rod 42*a* is positioned slightly away rearward from the bracket portion 32C of the shade 32, whereas when located at the excited position, the distal end is constructed so as to press against the bracket portion 32C of the shade 32, so that the shade 32 rotates to the high beam position. Two types of coils are provided on the solenoid 42: one for drawing, and the other for maintaining a contact. In other words, since the translation of the output rod 42*a* from the non-excited position to the excited position completes within a short period of time, the strong coil for drawing is used for this translation of the output rod 42*a*, whereas the weak coil for maintaining contact is used for holding the output rod 42*a* at the excited position. Thus, a small and economical but powerful solenoid 42 can be provided.

The tension coil spring 44 is disposed so as to expand in longitudinal directions, and a front end thereof is locked at the bracket portion 32C of the shade 32 and a rear end thereof is locked at a rear end wall of the solenoid accommodating portion 24*c*. This tension coil spring 44 functions to elastically bias the shade 32 toward the low beam position at all times.

As has been described in detail, the vehicle headlamp 10 according to the embodiment of the invention comprises the beam switching device 34 for rotating the shade 32 for screening part of the light from the discharge illuminant portion 22*a*, which has been reflected by the reflecting surface 24*a* of the reflector 24 between the two positions providing different light screening amounts. The beam switching device 34 comprises the tension coil spring 44 for elastically biasing the shade 32 toward the low beam position and the solenoid 42 for pressing against the shade 32 against the elastic biasing force of the tension coil spring 44 to rotate the shade 32 to the high beam position. Thus, the following function and advantage can be provided.

The solenoid 42 is simply constructed to press against the shade 32, and no conventional construction need be used in which the solenoid is coupled to the shade by means of a pin or the like. Therefore, the beam switching device 32 can be assembled to the projector unit 16 only by disposing the solenoid 42 and the tension coil spring 44 at the predetermined positions, respectively. Specifically, the shade 32 is attached to the holder 26 via the rotating pins 36, while the solenoid 42 is inserted for attachment and fixed in place in the solenoid accommodating portion 24*c* of the reflector 24, and the rear end of the tension coil spring 44 is locked at the rear end wall of the solenoid accommodating portion 24*c*. Thereafter, the front end of the tension coil spring 44 only has to be locked at the bracket portion 32C of the shade 32 when assembling the holder 26 and the reflector 24 together. Thus, the assembly of the project unit 16 can be facilitated.

Moreover, in the embodiment of the invention, when the shade rotates to reach the low beam position, the positioning member 40 secured to the lower end flange portion 24*b* of the reflector 24 is designed to come into abutment with the rear end flange portion 32C*a* of the bracket portion 32C of the shade 32. Hence, when the high beam is switched to the low beam, the shade 32 can be located accurately at the low beam position. Because of this construction, since the distal end of the output rod 42*a* of the solenoid 42 can be set at the non-excited position, which is located away from the bracket portion 32C of the shade 32, the alignment of the solenoid 44 (the positional adjustment of the output rod 42*a*) required for positioning and holding the shade 32 at the low beam position is not necessary. Thus, the construction of the beam switching device can be simplified.

Additionally, in the embodiment of the invention, when the shade 32 rotates to reach the high beam position, the positioning member 38 secured to the rear end flange portion 26*a* of the holder 26 is designed to come into abutment with the bracket portion 32C. Therefore, when the low beam is switched to the high beam, the shade 32 can also be located accurately at the high beam position.

Moreover, the respective positioning members 38, 40 are both made of rubber. Therefore, when the beams are switched, the striking noise can be advantageously and effectively prevented.

Furthermore, in this embodiment, since the beam switching device 34 is provided in the lower area of the reflector 24, the following function and advantage can be provided. By disposing the beam switching device 34 in the lower area, which is not as importance as the other areas in the reflector 24 with respect to the light distribution performance of the lamp, the beam switching device 34 can be provided with the space saving construction needing no wide space without adversely affecting the light distribution performance of the lamp.

Next, a second embodiment of the invention will be described.

Figure 4:
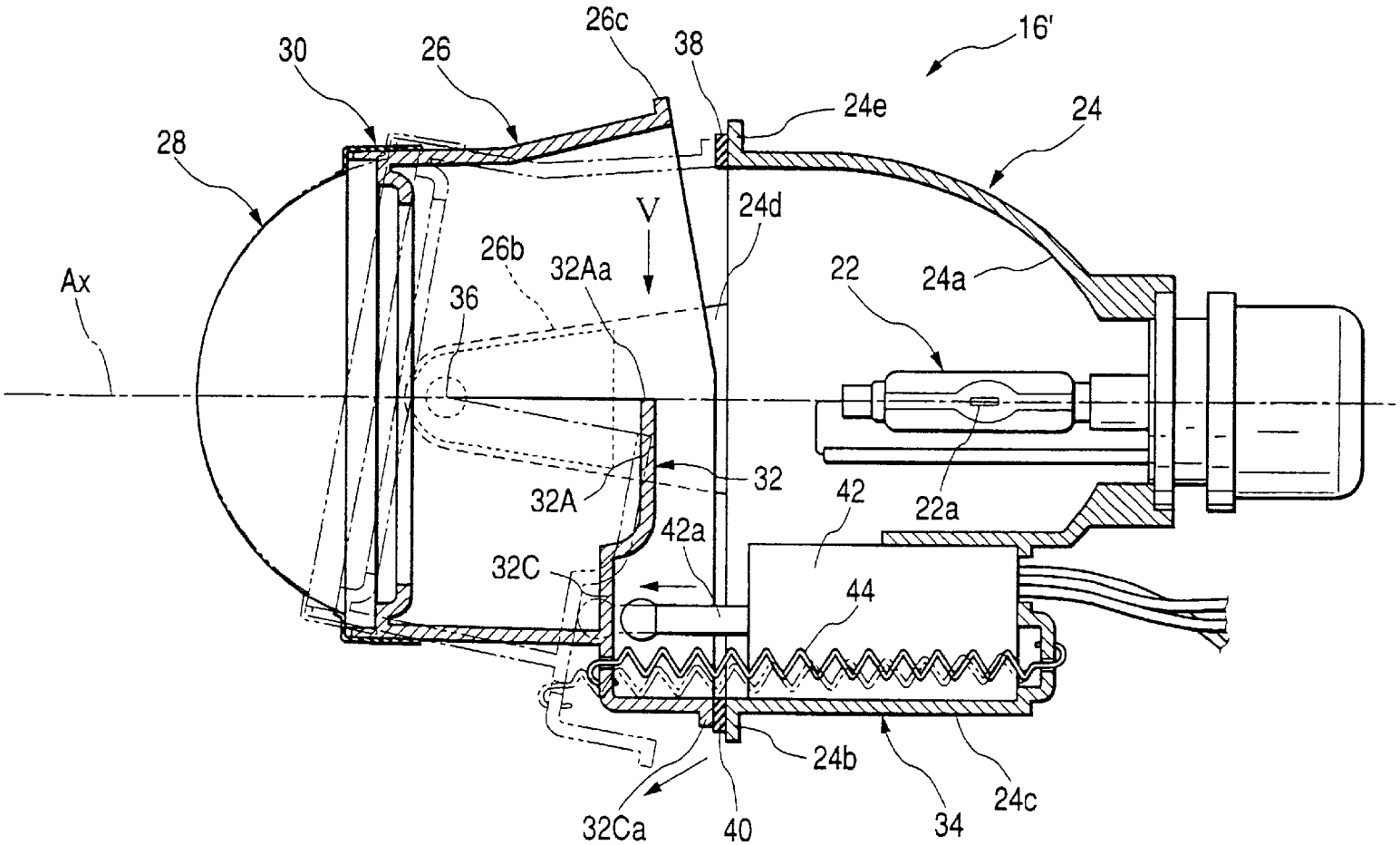
FIG. 4 is a side sectional view of a projector unit for a vehicle headlamp according to a second embodiment of the invention.
Figure 5:
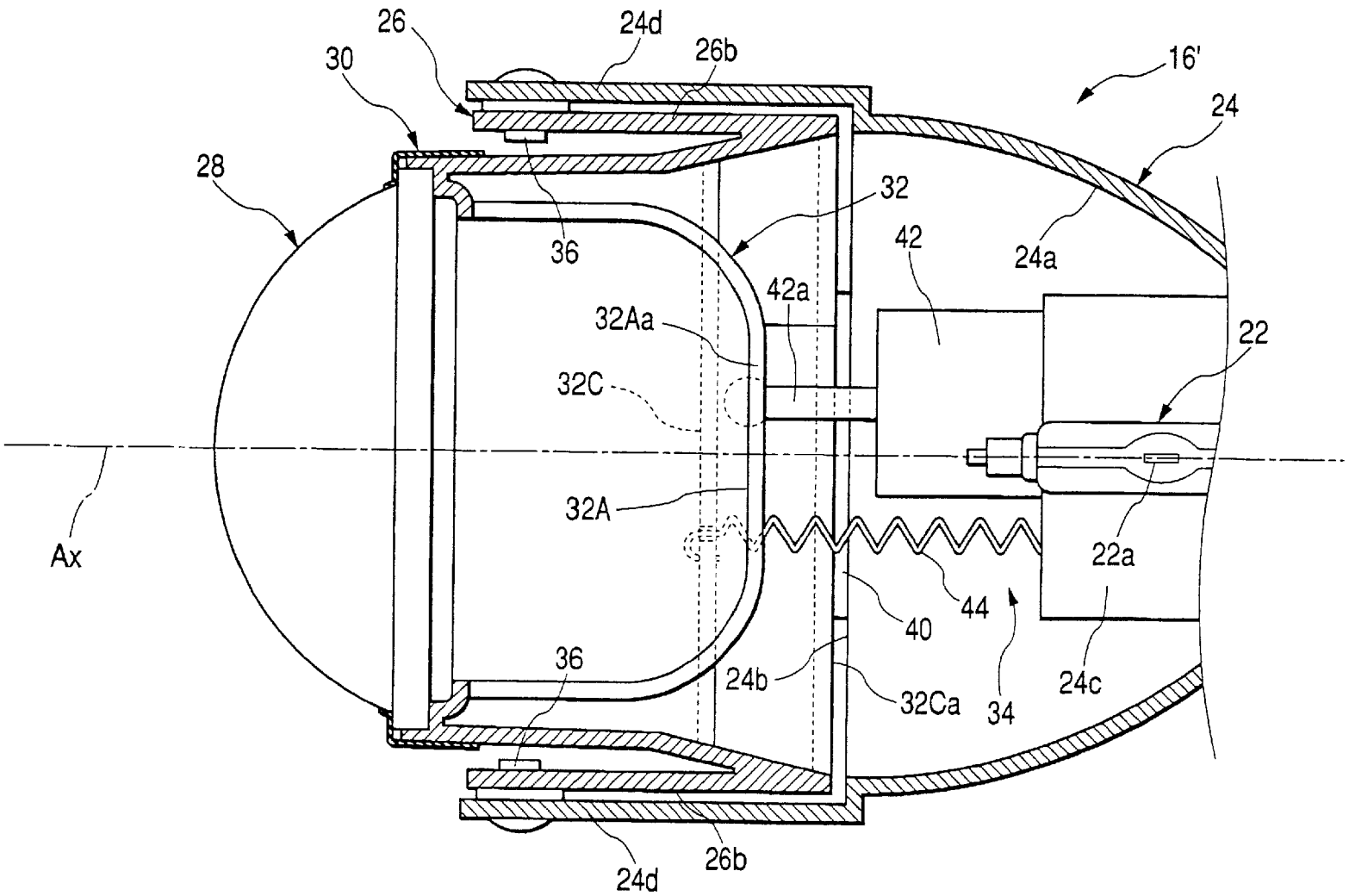
FIG. 5 is a view in the direction indicated by an arrow V of FIG. 4.

FIG. 4 is a side sectional view showing singly a projector unit 16' for a vehicle headlamp according to this embodiment of the invention, and FIG. 5 is a view in the direction indicated by an arrow V in FIG. 4.

A vehicle headlamp (a lamp) according to the second embodiment of the invention is also a projector type headlamp. While the basic construction thereof is similar to that of the headlamp described in the first embodiment, the construction of the projector unit 16' is different from that of the projector unit 16 of the first embodiment.

Namely, as shown in FIGS. 4 and 5, in the projector unit 16' according to the embodiment, a shade 32 is formed integrally with a holder 26, and when beams are switched over, the holder 26, a focusing lens 28 and a retaining ring 30 are constructed to rotate together with the shade 32.

This rotation is performed about a horizontal axis connecting a pair of left and right rotating pins 36, as with the first embodiment, and the shade 32 is, as with the first embodiment, constructed so as to take two positions; a low beam position (a position shown by solid lines in the figure) and a high beam position (a position shown by chain double-dashed lines in the figure). The rotating pins 36 are each constructed so as to connect distal ends of one of a pair of left and right bracket portions 26*b* formed on the holder 26 and one of a pair of left and right bracket portion 24*d* extending forward from a front end opening of a reflector 24.

Also in this embodiment, the switching operation between the low beam and the high beam is designed to be effected by a beam switching device 34 disposed in a lower area in the reflector 24. In the beam switching device 34, the shade 32 is constructed to be pressed by a solenoid 42 against the elastic biasing force of a tension coil spring 44 for elastically biasing the shade 32 toward the low beam position to rotate to the high beam position.

Also in this embodiment, when the shade 32 rotates to the low beam position, a positioning member 40 secured to a lower flange portion 24*b* of the reflector 24 is constructed to come into abutment with a rear end flange portion 32C*a* of a bracket portion 32C of the shade 32.

However, in the second embodiment, a positioning member 38 for positioning the shade 32 accurately at the high beam position when the low beam is switched to the high beam is secured to an upper flange portion 24*e* of the reflector 24. Then, a rear end flange portion 26*c* is formed at an upper end of the holder 26 which is designed to come into abutment with the position member 38 when the shade 32 rotates to the high beam position.

Thus, in the construction according to this embodiment, the solenoid 42 is constructed to simply press the shade 32. Therefore, since the solenoid 42 is not constructed in the conventional fashion in which the solenoid is coupled to the shade by means of a pin or the like, the beam switching device 34 can be assembled to the projector unit 16' only by disposing the solenoid 42 and the tension coil spring 44 at the predetermined positions, respectively. Additionally, other functions and advantages similar to those of the first embodiment can be obtained.

Next, a third embodiment of the invention will be described.

Figure 6:
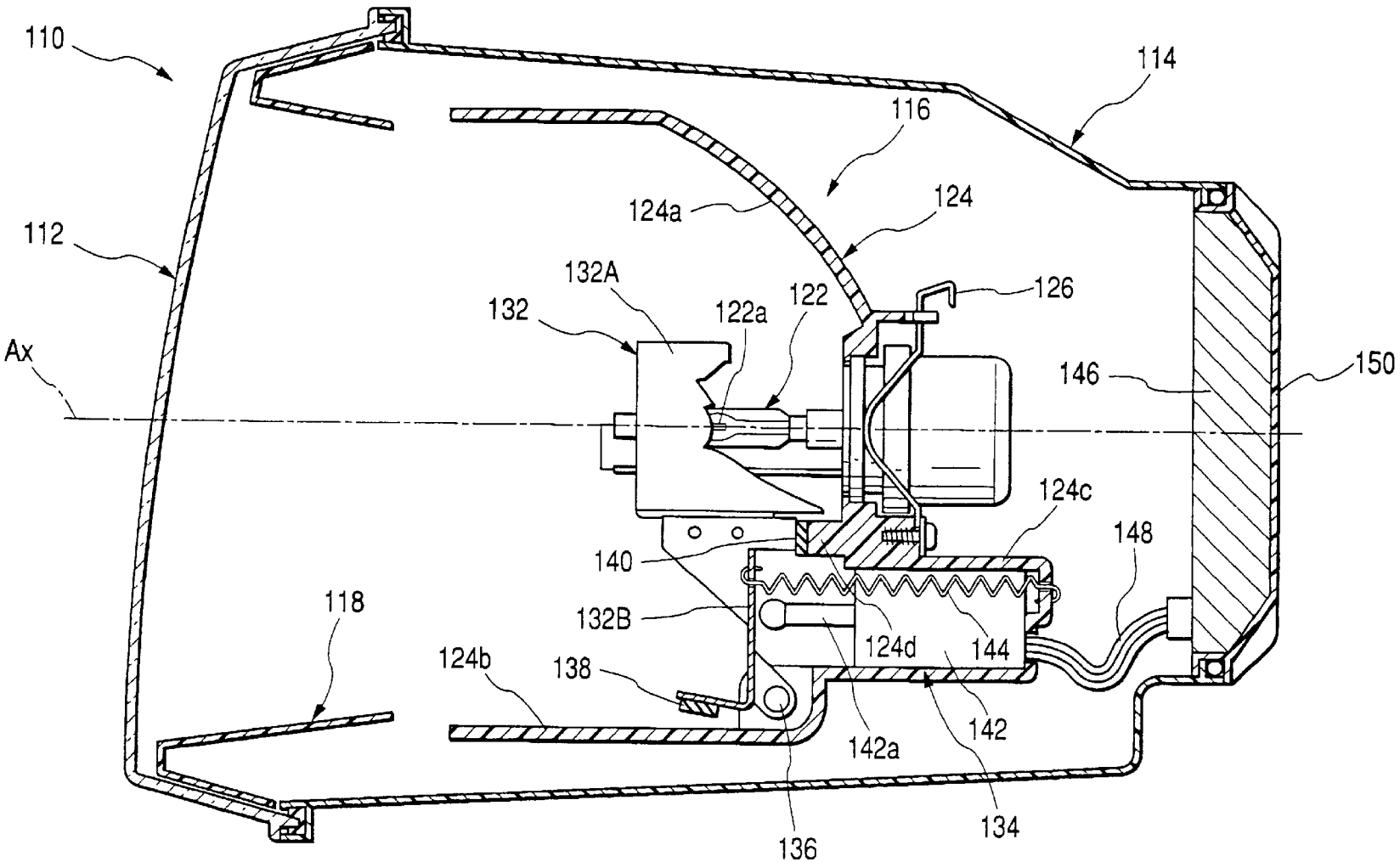
FIG. 6 is a side sectional view of a vehicle headlamp according to a third embodiment of the invention.
Figure 7:
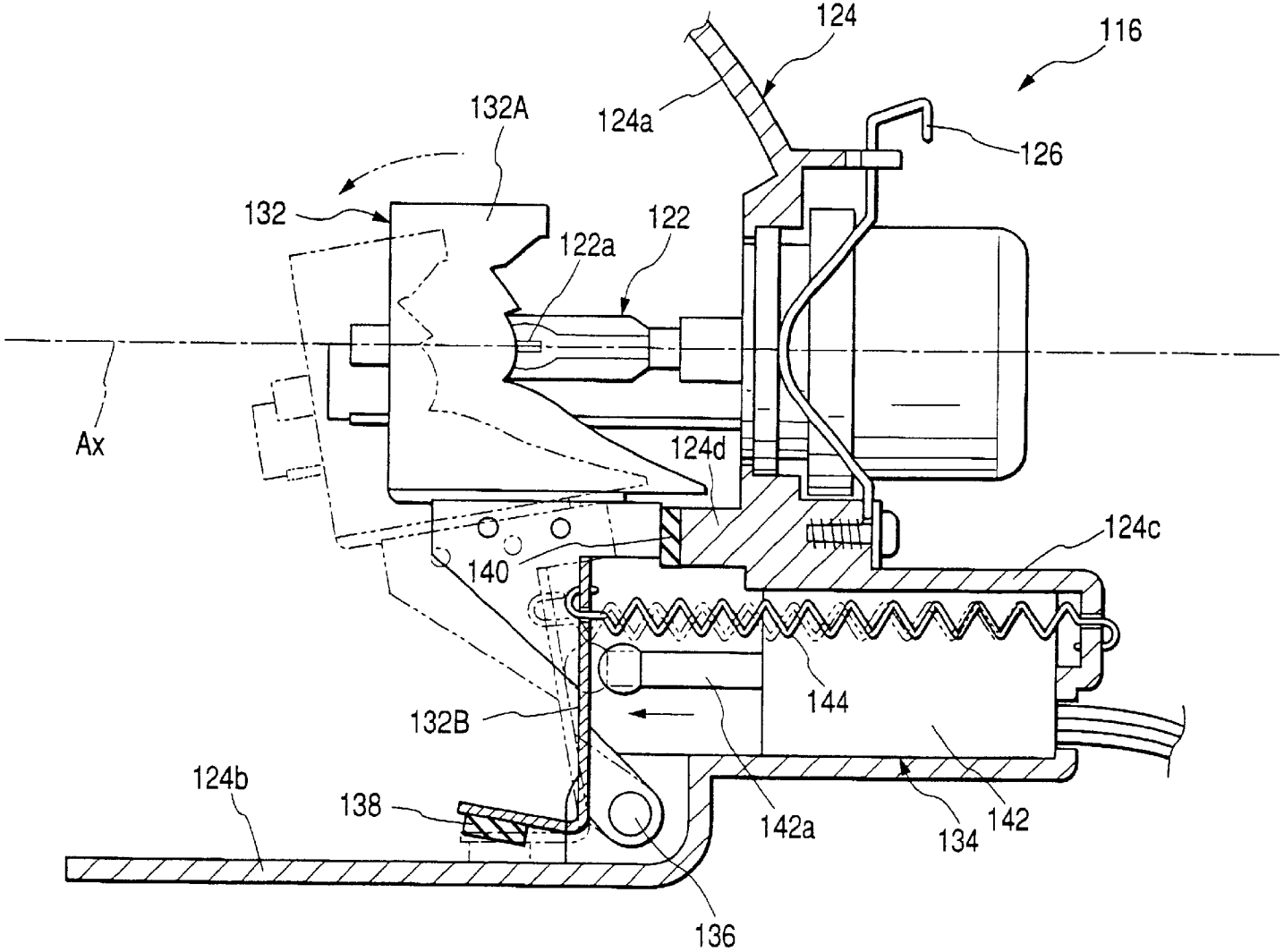
FIG. 7 is a diagram of a main portion of FIG. 6.

FIG. 6 is a side sectional view of a vehicle headlamp according to the embodiment of the invention, and FIG. 7 is a diagram showing in detail a main part of FIG. 6.

As shown in these figures, a vehicle headlamp (a lamp) 110 according to the third embodiment of the invention is a parabolic-type headlamp. A reflector unit 116 is provided in such a manner as to tilt in vertical and horizontal directions in a lamp chamber formed by a transparent front lens 112 and a lamp body 114. An extension panel 118 is provided in front of the reflector unit 116.

The reflector unit 116 comprises a discharge bulb 122, a reflector 124, a shade 132 and a beam switching device 134.

The discharge bulb 122 is a metal halide bulb and is attached to the reflector 124 with a liner spring 126 in such a manner that a discharge illuminant portion 122*a* (a light source) is positioned on a lamp optical axis Ax extending in a longitudinal direction of the vehicle.

The reflector 124 has a reflecting surface 124*a* formed by a plurality of reflecting elements based on a paraboloid using the lamp optical axis Ax as a central axis, and is constructed so as to form a predetermined light distribution pattern by reflecting forward part of light from the discharge illuminant portion 122*a* in diffusing and deflecting fashions.

The shade 132 is constituted by a cylindrical shade main body 132A whose rear end edge is formed into a complicated irregular configuration and a stay 132B extending downward from a lower end of the shade main body 132A, the shade main body and the stay being fixed together with a rivet, and the shade 132 is rotatably supported on a lower end of the reflector 124 via rotating pins 136 at a lower end of the stay 132B. Thus, the shade 132 is constructed so as to rotate between two positions; a low beam position (a position shown by solid lines in the figure) and a high beam position (a position shown by chain double-dashed lines in the figure)

When located at the low beam position, the shade 132 screens part of light incident into the reflecting surface 124*a* of the reflector 124 from the discharge illuminant portion 122*a* of the discharge bulb 122 using the shade main body 132A, while allowing light only required for the low beam to enter the reflecting surface 124*a*. On the other hand, when located at the high beam position, the shade 132 is constructed so as to reduce the screened incident light which would otherwise enter into the reflecting surface 124*a*, so that an amount of light required for the high beam is secured.

The stay 132B of the shade 132 is a product made out of a metal plate by bending the same, and a lower end of the stay 132B is formed so as to bend forward into an L-shape, with a positioning member 138 made of a rubber being secured to a bottom surface of the lower end. Then, when the shade 132 rotates to reach the high beam position, the positioning member 138 is designed to come into abutment with the lower wall portion 124*b* of the reflector 124.

Additionally, a projection 124*d* is formed on the reflector 124 at a position corresponding to a rear position at an upper end of the stay 132B of the shade 132, and a rubber positioning member 140 is secured to a front end face of the projection 14*d*. When the shade 132 rotates to the low beam position, the positioning member 140 is designed to come into abutment with the stay 132B of the shade 132.

The beam switching device 134 comprises a solenoid 142 (an actuator), a tension coil spring 144 (an elastic member) and a solenoid driving circuit 146. Switching between the low beam and the high beam is implemented by rotating the shade 132 between the low beam position and the high beam position.

The solenoid 142 is inserted for attachment and fixed in place in a solenoid accommodating portion 124*c* formed in a lower area of the reflector 124, and an output rod 142*a* thereof extends forward. The solenoid 142 is constructed so as to selectively move the output rod 142*a* to either of a non-excited position (a position indicated by solid lines) and an excited position (a position indicated by chain lines), which is located forward to the non-excited position, when a signal is sent to the solenoid 142 from a beam selector switch, which is not shown. When located at the non-excited position, a distal end of the output rod 142*a* is positioned slightly away rearward from the stay 132B of the shade 132, whereas when located at the excited position, the distal end is constructed so as to press against the stay 132B of the shade 132 so that the shade 32 rotates to the high beam position.

The tension coil spring 144 is disposed so as to expand in longitudinal directions, and a front end thereof is locked at the stay 132B of the shade 132 and a rear end thereof is locked at a rear end wall of the solenoid accommodating portion 124*c*. This tension coil spring 44 functions to elastically bias the shade 132 toward the low beam position at all times.

The solenoid driving circuit 146 is a circuit for driving the solenoid 142. As shown in FIG. 6, when in a state in which the circuit is connected to the solenoid 142 via cords 148, the solenoid driving circuit is fixed to a back cover 150 attached to a rear end of the lamp body 114 in a space inside the cover 150.

As has been described in detail, the vehicle headlamp 110 according to the embodiment of the invention comprises the beam switching device 134 for rotating the shade 132 for screening part of the light from the discharge illuminant portion 122*a*, which has been reflected by the reflecting surface 124*a* of the reflector 124 between the two positions providing different light screening amounts. The beam switching device 134 comprises the tension coil spring 144 for elastically biasing the shade 132 toward the low beam position and the solenoid 142 for pressing against the shade 132 against the elastic biasing force of the tension coil spring 44 to rotate the shade 132 to the high beam position. Thus, the following function and advantage can be provided.

The solenoid 142 is simply constructed to press against the shade 132, and no conventional construction is used in which the solenoid is coupled to the shade by means of a pin or the like. Therefore, the beam switching device 134 can be assembled to the projector unit 116 only by disposing the solenoid 142 and the tension coil spring 144 at the predetermined positions, respectively. Specifically, the solenoid 142 is inserted for attachment and fixed in place in the solenoid accommodating portion 124*c* of the reflector 124, and the rear end of the tension coil spring 144 is locked at the rear end wall of the solenoid accommodating portion 124*c*. Thereafter, the shade 132 is attached to the reflector 124 via the rotating pins 136, and the front end of the tension coil spring 144 only has to be locked at the stay 132B of the shade 132. Thus, the assembly of the project unit 116 can be facilitated.

Moreover, in the embodiment of the invention, when the shade 132 rotates to the low beam position, the positioning member 140 secured to the reflector 124 is designed to come into abutment with the stay 132B of the shade 132. Therefore, when the high beam is switched to the low beam, the shade 132 can be located accurately at the low beam position. Because of this construction, since the distal end of the output rod 142*a* of the solenoid 142 can be set at the non-excited position which is located away from the stay 132B of the shade 132, the alignment of the solenoid 144 (the positional adjustment of the output rod 142*a*) required for positioning and holding the shade 132 at the low beam position can be obviated. Thus, the construction of the beam switching device can be simplified.

Additionally, in the embodiment of the invention, when the shade 132 rotates to the high beam position, the positioning member 138 secured to the stay 132B of the shade 132 is designed to come into abutment with a lower wall portion 124*b* of the reflector 124. Therefore, when the low beam is switched to the high beam, the shade 132 can also be accurately located at the high beam position.

Moreover, the respective positioning members 138, 140 are both formed of rubber, and therefore, when the beams are switched over, the striking noise can be advantageously and effectively prevented.

Furthermore, in this embodiment, since the beam switching device 134 is provided in the lower area of the reflector 124, the following function and advantage can be provided. By disposing the beam switching device 134 in the lower area, which is not as importance as the other areas in the reflector 24 with respect to the light distribution performance of the lamp, the beam switching device 134 can be provided with the space saving construction needing no wide space without adversely affecting the light distribution performance of the lamp.

Several embodiments of the invention have been described herein, but it should be understood that various additions and modifications could be made which fall within the scope of the following claims.

What is claimed is:

1. A vehicle headlamp comprising:

a light source;

a reflector surrounding said light source for reflecting light from said light source forwardly;

a shade disposed in front of the light source and movably attached to said vehicle headlamp for variably screening light from said light source;

a beam switching device configured to contact detachably and press said shade against an elastic biasing force to move said shade from a first position to a second position; and a convex lens which is disposed in front of the light source and rotates with said shade.

2. The vehicle headlamp as set forth in claim 1, wherein said beam switching device is disposed in a lower area of said reflector.

3. The vehicle headlamp of claim 1 wherein said beam switching device comprises:

an elastic member for elastically biasing said shade to the first position; and an actuator for pressing said shade against the elastic biasing force of said elastic member to rotate said shade to the second position.

4. The vehicle headlamp of claim 1 wherein said shade screens incident light from said light source or light reflected from said reflector.

5. The vehicle headlamp of claim 1 wherein said beam switching device is constructed to switch between a low beam and a high beam.

6. The vehicle headlamp of claim 1 wherein said beam switching device can retract from said shade to let the elastic biasing force pull said shade back to the first position.

7. The vehicle headlamp as set forth in claim 1 wherein a high beam is secured to an upper flange portion of said reflector.

8. The vehicle headlamp set forth in claim 1 wherein said reflector has a reflecting surface formed by a plurality of reflecting elements based on a paraboloid of revolution and said shade is configured to have a semi-cylindrical shape surrounding said light source.

9. The vehicle headlamp as set forth in claim 3, wherein said elastic member comprises a spring or a rubber.

10. The vehicle headlamp as set forth in claim 3, wherein said actuator comprises a solenoid or a motor.

11. The vehicle headlamp of claim 3 wherein said beam switching device is located below the light source and said actuator is configured to press a downward extension of shade to rotate the shade to the second position.

12. A vehicle headlamp comprising:

a light source;

a reflector surrounding said light source for reflecting light from said light source forwardly;

a shade disposed in front of the light source and movably attached to said vehicle headlamp for variably screening light from said light source;

a beam switching device configured to contact detachably and press said shade against an elastic biasing force to move said shade from a first position to a second position;

wherein said reflector is configured to have a semi-ellipsoidal shape surrounding the light source such that a first focal point is disposed at the light source and the second focal point is disposed forwardly away from the light source, and an optical axis passes through said first focal point and said second focal point.

13. The vehicle headlamp of claim 12 wherein said shade is configured to rotate about a horizontal axis perpendicular to the optical axis.

14. The vehicle headlamp of claim 12 wherein said shade is configured to rotate about the horizontal axis to pass through the second focal point for variably screening the light from the light source.

* * * * *